US005245727A

United States Patent [19]

Sasaki

[11] Patent Number: 5,245,727

[45] Date of Patent: Sep. 21, 1993

[54] ADJUSTABLE HINGE

[75] Inventor: Yoshito Sasaki, Tokyo, Japan

[73] Assignee: Ohta Co., Ltd., Tokyo, Japan

[21] Appl. No.: 858,715

[22] Filed: Mar. 27, 1992

[30] Foreign Application Priority Data

Oct. 9, 1991 [JP] Japan ..... 3-81978[U]

[51] Int. Cl.[5] ..... E05D 7/10; E05D 7/06; E05D 5/00

[52] U.S. Cl. ..... 16/258; 16/240; 16/382

[58] Field of Search ..... 16/258, 254, 382, 383, 16/384, 240, DIG. 34, DIG. 43

[56] References Cited

U.S. PATENT DOCUMENTS 4,091,500 5/1978 Lautenschlager ..... 16/383
4,654,932 4/1987 Rock et al. ..... 16/258

FOREIGN PATENT DOCUMENTS 1559940 3/1972 Fed. Rep. of Germany .
48-35255 5/1973 Japan .
62-189273 8/1987 Japan .
63-265089 11/1988 Japan .
64-36884 2/1989 Japan .
4-22682 5/1992 Japan .

*Primary Examiner*—James F. Coan
*Assistant Examiner*—Carmine Cuda
*Attorney, Agent, or Firm*—Foley & Lardner

[57] ABSTRACT

An adjustable hinge for pivotally connecting a door member to a receptacle member is disclosed. The hinge comprises a first structure having a pivotal male member; a second structure secured to the receptacle member, the second structure and the first structure being detachably connectable; and a third structure secured to the door member and having a female member with which the male member is latchedly engageable.

16 Claims, 8 Drawing Sheets

ADJUSTABLE HINGE

BACKGROUND OF THE INVENTION

1. Field of the Invention

The present invention relates in general to hinges, and more particularly to hinges used in furnitures, furnishings or the like, for pivotally connecting a door member to a receptacle member. More specifically, the present invention is concerned with hinges of an adjustable type which can be easily mounted to various furnitures without need of skilled mounting technique.

2. Description of the Prior Art

In order to clarify the task of the present invention, one conventional hinge of the above-mentioned type will be described with reference to FIG. 10 of the accompanying drawings, which hinge is disclosed in Japanese Patent First Provisional Publication 62-189273.

In the drawing, there is shown the conventional adjustable hinge 100 by which a door member 14 is pivotally connected to a receptacle member 25.

The adjustable hinge 100 generally comprises a first structure 24 carried by the door member 14 and a second structure 28 carried by the receptacle member 25, these two structures 24 and 28 being detachably connected to each other for the pivotal connection between the door member 14 and the receptacle member 25, as will become apparent as the description proceeds.

The first structure 24 comprises a cup member 15 tightly fitted in a recess (no numeral) formed in an inside surface of the door member 14. Two links 16 and 17 are received in the cup member 15 and pivotally connected at their one ends to the cup member 15 through respective shafts 18 and 19. These two links 16 and 17 have other ends to which one end of an arm member 22 is pivotally connected through respective shafts 20 and 21. A position-adjustable lever member 23 is adjustably connected through a fixing bolt 29 to the arm member 22 and extends along the same. When the bolt 29 is loosened, the lever member 23 can be axially moved relative to the arm member 22.

The second structure 28 comprises a base plate 26 secured to an inside surface of the receptacle member 25. A catch plate 27 is connected through a bolt 30 to the base plate 26 and extends along the same. The catch plate 27 is shaped to detachably catch the adjustable lever member 23 of the first structure 24.

In the first structure 24, the arm member 22 and the adjustable lever member 23 are of a channel member and the adjustable lever member 23 is received in the arm member 22, as shown. One end of the adjustable lever member 23 is equipped with a pin 31. The other end of the lever member 23 has a pivotal latch member 32 pivotally connected thereto through a shaft **32*a*. A coil spring 33 is disposed about the shaft 32*a* to bias the latch member 32 in a counterclockwise direction in the drawing. The latch member 32 is formed with a hook portion 32*b***.

In the second structure 28, the catch plate 27 is formed with a sloped portion 34 on which the pin 31 slides and a smaller recessed portion 35 to which the pin 31 is latchedly engageable. The catch plate 27 is further formed with a tapered portion 36 on which the latch member 32 slides and a larger recessed portion 37 to which the hook portion **32*b* of the latch member 32** is latchedly engageable.

When the adjustable lever member 23 is pressed against the catch plate 27 having the pin 31 held on the sloped portion 34 and having the hook portion **32*b* of the latch member 32 held on the tapered portion 36, the lever member 23 and the latch member 32 are brought into latched engagement with the catch plate 27 to achieve coupling of the first and second structures 24 and 28. During this, the pin 31 slides on the sloped portion 34 and finally drops into the smaller recessed portion 35 and at the same time the hook portion 32*b* of the latch member 32 slides on the tapered portion 36 and finally drops into the larger recessed portion 37 against the biasing force of the spring 33**.

Thus, upon proper coupling of the two structures 24 and 28, the pin 31 is caught or latched by the smaller recessed portion 35 and the hook portion of the latch member 32 is caught or latched by the larger recessed portion 37. Due to the biasing force of the spring 33 applied to the latch member 32, the latched connection of these two structures 24 and 28 is assured. Thus, the door member 14 is pivotally movable relative to the receptacle member 25 along a way determined by the links 16 and 17.

However, due to its inherent construction, the above-mentioned conventional adjustable hinge 100 has the following drawbacks.

First, the manual work for properly coupling the two structures 24 and 28 is very troublesome and requires a highly skilled technique. That is, because the second structure 28 is secured to the receptacle member 25 which is weighty and thus not easily movable and the first structure 24 is secured to the door member 14, the above-mentioned coupling work must be carried out by handling the door member 14 as well as the first structure 24. In fact, prior to the coupling, several attempts for adjusting the position of the lever member 23 relative to the arm member 22 must be made while holding the door member 14. Such attempts are troublesome and time consuming.

In order to facilitate such coupling work, some measures have been proposed by Japanese Patent First Provisional Publications 48-35255 and 63-265089. In these measures, the hinge is constructed of three major structures. However, even in these measures, satisfied result has not been obtained in facilitating the coupling work.

SUMMARY OF THE INVENTION

It is therefore an object of the present invention to provide an adjustable hinge which is free of the above-mentioned drawbacks.

According to the present invention, there is provided a so-called one touch coupling means between a structure secured to the receptacle member and another structure secured to the door member.

According to the present invention, there is provided an adjustable hinge for pivotally connecting a door member to a receptacle member. The hinge comprises a first structure having a pivotal male member; a second structure secured to the receptacle member, the second structure and the first structure being detachably connectable; and a third structure secured to the door member and having a female member with which the male member is latchedly engageable.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
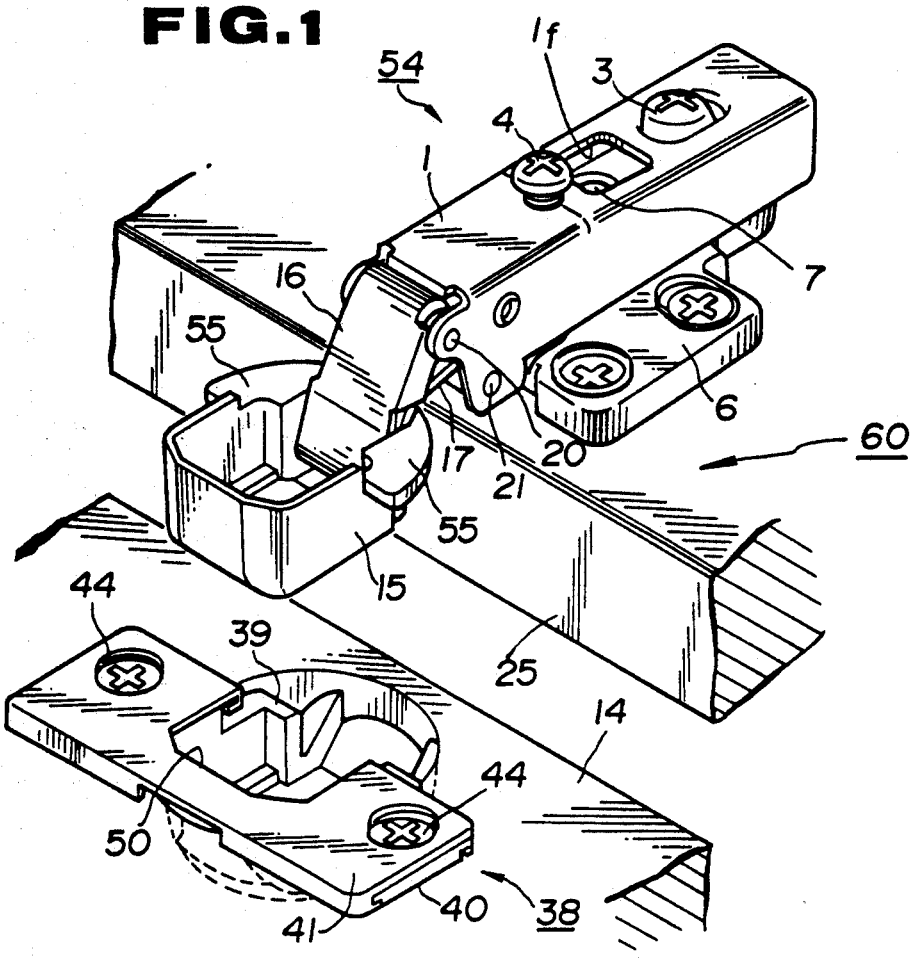
FIG. 1 is a perspective view of an adjustable hinge according to the present invention, which generally comprises first, second and third structures.

Referring to FIGS. 1 to 8E, particularly FIG. 1, there is shown an adjustable hinge according the present invention.

As will become apparent as the description proceeds, the adjustable hinge of the invention comprises generally three major structures, viz., first, second and third structures 54, 60 and 38 which can be easily joined or assembled with simple coupling manual work. Upon assembly, the hinge can pivot a door member 14 relative to a receptacle member 25.

The first structure 54 is detachably mounted to the second structure 60 which is secured to the receptacle member 25.

As is seen from FIG. 1, the first structure 54 comprises a cup member 15 which is pivotally connected to one end of an arm member 1 through two links 16 and 17. The arm member 1 has a channel structure, like in the case of the afore-mentioned conventional hinge 100. The cup member 15 is formed at its mouth portion with two triangular small flanges 55 and 55. The flanges 55 are located somewhat below the upper peripheral edge of the cup member 15, as shown.

Figure 2:
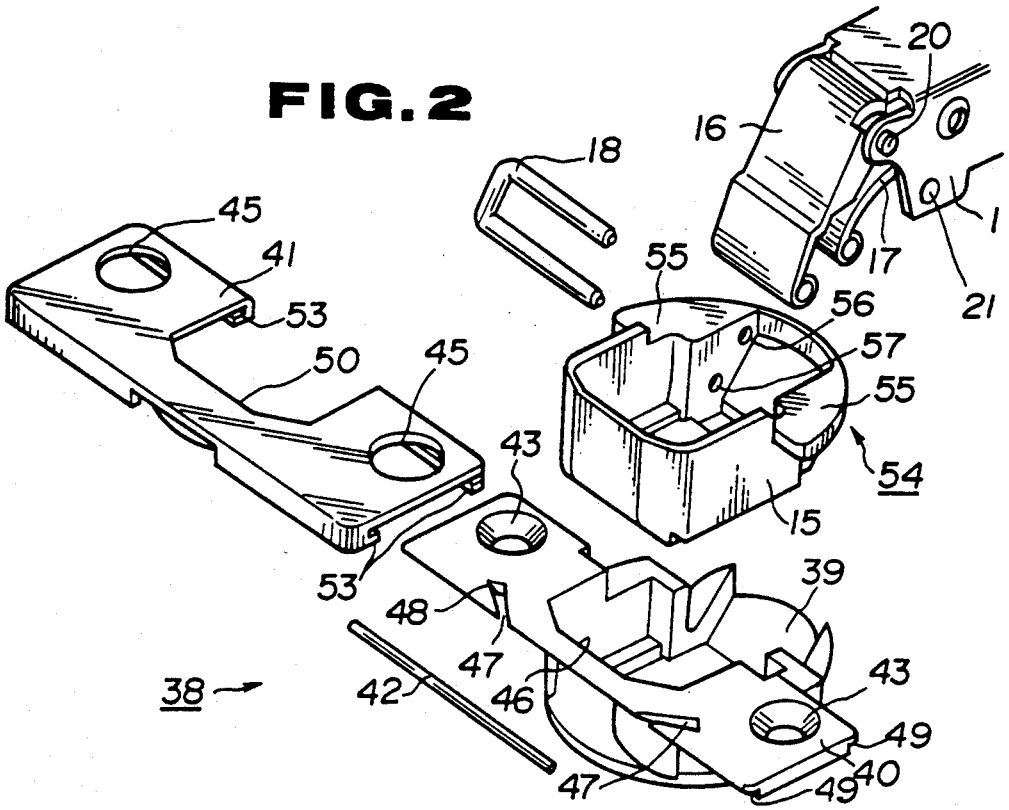
FIG. 2 is an exploded view of the adjustable hinge of the invention with some parts not illustrated.

As is seen from FIG. 2, the pivotal connection of the two links 16 and 17 to the cup member 15 is made through a generally U-shaped pin 18 which has two parallel shaft portions passed through openings 56 and 57 formed in the cup member 15. The pivotal connection of the two links 16 and 17 to the arm member 1 is made through respective shafts 20 and 21.

Figure 6:
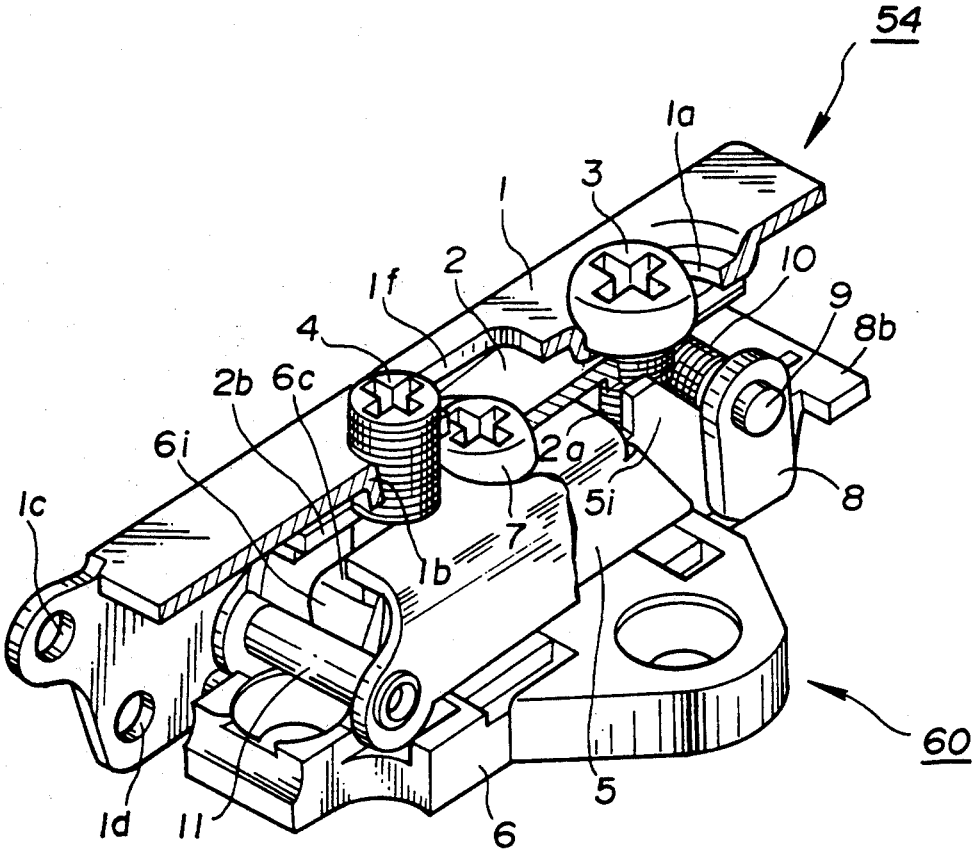
FIG. 6 is a partially cut perspective view of a part of the adjustable hinge of the invention, showing the first and second structures which are coupled.
Figure 7:
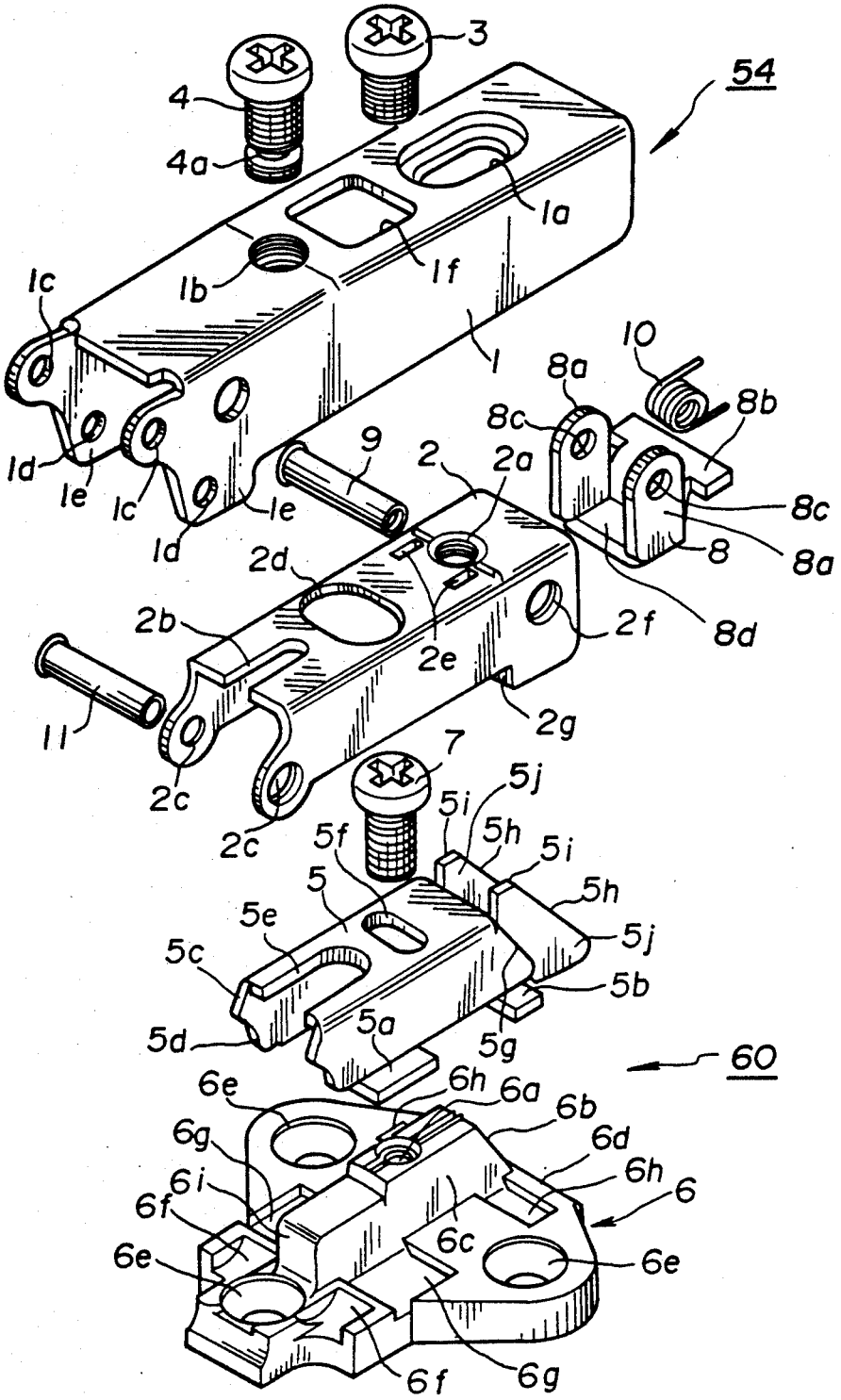
FIG. 7 is an exploded view of the first and second structures.

As is understood from FIGS. 6 and 7, the arm member 1 has a position adjustable lever member 2 connected to an inside surface thereof. The lever member 2 has a channel structure.

The arm member 1 is formed with a longitudinally extending opening 1*a* which has a stepped periphery and the lever member 2 is formed with a threaded opening 2*a*. A fixing bolt 3 passes through the elongate opening 1*a* and is screwed into the threaded opening 2*a*. Thus, when the fixing bolt 3 is loosened, the position of the lever member 2 relative to the arm member 1 can be varied by a degree corresponding to the moved distance of the bolt 3 within the elongate opening 1*a*. When the fixing bolt 3 is tightened, the lever member 2 becomes fixed to the arm member 1 at a selected position.

As is best seen from FIG. 7, the arm member 1 is formed with a threaded opening 1*b* with which another bolt 4 is engaged. The bolt 4 has at its leading end portion an annular groove 4*a* with which opposed edge portions of a longitudinally extending groove 2*b* formed in the lever member 2 are slidably engaged. The annular groove 4*a* has an eccentric bottom surface, so that when the bolt 4 is turned about its axis, the lever member 2 is pivoted but slightly about the axis of the fixing bolt 3.

It is to be noted that the arm member 1 and the lever member 2 are united with each other by the two bolts 3 and 4.

Designated by numerals 1*c*, 1*c*, 1*d* and 1*d* are openings (see FIG. 7) formed in front portions of side walls of the arm member 1, through which the afore-mentioned shafts 20 and 21 pass. The front portions of the side walls have each a stepped lower portion 1*e*. The arm member 1 is further formed between the elongate opening 1*a* and the threaded opening 1*b* with a rectangular opening 1*f* for the purpose which will become apparent hereinafter.

As is seen from FIGS. 6 and 7, the lever member 2 is formed at front portions of side walls thereof with aligned openings 2*c* and 2*c* through which a latch pin 11 is passed and held in position. The lever member 2 is provided at its rear end with a pivotal latch member 8. The latch member 8 is pivotally connected to the lever member 2 through a pivot shaft 9. The latch member 8 is of a generally U-shaped structure which includes a base part 8*d* and opposed side brackets 8*a* and 8*a*. The side brackets 8*a* and 8*a* are formed with aligned openings 8*c* and 8*c* which are mated with openings 2*f* formed in rear portions of the side walls of the arm member 1. The pivot shaft 9 is passed through these mated openings 8*c* and 2*f* to achieve the pivotal connection of the latch member 8 to the lever member 2. A coil spring 10 is disposed about the the pivot shaft 9 to bias the latch member 8 in a clockwise direction in FIG. 7 (or FIG. 6) relative to the lever member 2. The U-shaped latch member 8 is integrally formed with a generally T-shaped handle portion 8*b* which extends rearward from the base part 8*d*. The side walls of the lever member 2 are formed at rear lower portions with recessed portions 2*g* and 2*g* respectively.

The lever member 2 is formed between the groove 2*b* and the threaded opening 2*a* with a larger oval opening 2*d* which is mated with the afore-mentioned rectangular opening 1*f* of the arm member 1. The lever member 2 further has between the oval opening 2*d* and the threaded opening 2*a* a pair of rectangular slits 2*e* and 2*e* which are spaced in the direction of the width of the lever member 2, as shown.

The first structure 54 having the above-mentioned construction is detachably connectable in a snap action manner to the second structure 60 which is securely mounted on the receptacle member 25.

As is seen from FIGS. 6 and 7, the second structure 60 essentially comprises a base plate 6 which is bolted to the receptacle member 25 and a catch plate 5 which is bolted to the base plate 6 in an after-mentioned manner.

The base plate 6 is formed with three openings 6*e*, 6*e* and 6*e* through which screws (not shown) are passed and screwed into a rigid portion of the receptable member 25 to achieve a tight connection of the base plate 6 to the receptacle member 25. The base plate 6 is formed on an upper surface 6*d* thereof with an elongate ridge portion 6*c* which has a vertical front wall 6*i* and a tapered rear wall 6*b*. As shown, the ridge portion 6*c* extends on a center part of the base plate 6. The ridge portion 6*c* has a threaded opening 6*a* formed therein. The base plate 6 is formed at both sides of the ridge portion 6*c* with three pairs of recesses (6*f*, 6*f*), (6*g*, 6*g*) and (6*h*, 6*h*). The recesses (6*g*, 6*g*) and (6*h*, 6*h*) have each a flat bottom surface, while the front recesses (6*f*, 6*f*) have each a curved bottom surface.

The catch plate 5 has a channel construction and is laterally movably received or mounted on the ridge portion 6*c* of the base plate 6. Upon mounting of the catch plate 5 on the ridge portion 6*c*, two pairs of lateral flanges (5*a*, 5*a*) and (5*b*, 5*b*) of the catch plate 5 are seated on the flat bottom surfaces of the recesses (6*g*, 6*g*) and (6*h*, 6*h*) of the base plate 6. Two side walls of the catch plate 5 have at their front ends respective sloped portions 5*c* and 5*c* and respective recessed portions 5*d* and 5*d* . An upper base wall of the catch plate 5 is formed at its front end portion with a longitudinally extending relatively larger groove 5*e* and at its rear portion with a laterally extending slot 5*f*. As will be described hereinafter in detail, the lateral slot 5*f* is an opening through which a connecting bolt 7 is passed for bolting the catch plate 5 to the base plate 6. The two side walls of the catch plate 5 have at their rear ends respective tapered portions 5*g* and 5*g*. The catch plate 5 is further provided at its rear end two pawl plates 5*j* and 5*j* each including a sloped rear part 5*h* and a projected upper part 5*i*. As is seen from FIG. 7, the distance between the two identical pawl plates 5*j* and 5*j* is somewhat smaller than that between the side walls of the catch plate 5. The projected upper parts 5*i* and 5*i* are so sized as to be mated with the afore-mentioned paired slits 2*e* and 2*e* of the lever member 2.

In order to secure the catch plate 5 to the base plate 6, the connecting bolt 7 is passed through the slot 5*f* of the catch plate 5 and screwed into the threaded opening 6*a* of the ridge portion 6*c* of the base plate 6. With this, the second structure 60 is properly assembled.

It is thus to be noted that by loosening the connecting bolt 7, the catch plate 5 can be moved laterally relative to the base plate 6. Thus, the position of the catch plate 5 relative to the receptacle member 25 to which the base plate 6 is securely connected can be adjusted.

In order to couple the first and second structures 54 and 60, the following coupling steps are carried out, which will be described with reference to FIGS. 8A to 8D of the accompanying drawings.

Figure 8A:
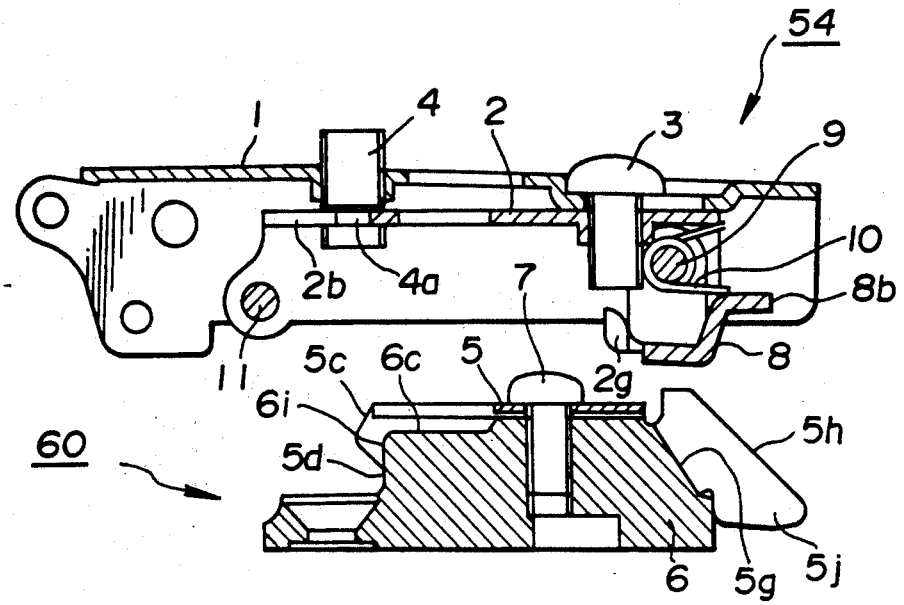
FIGS. 8A, 8B, 8C and 8D are sectional views of the first and second structures, showing the steps for coupling them.

First, as is seen from FIG. 8A, the first structure 54 is placed above the second structure 60 facing the lever member 2 toward the catch plate 5 of the second structure 60. Then, the first structure 54 is pressed against the second structure 60 having the latch pin 11 put on the front sloped portions 5*c* and 5*c* of the catch plate 5 and having the spring-biased latch member 8 put on the sloped rear parts 5*h* and 5*h* of the catch plate 5.

Figure 8B:
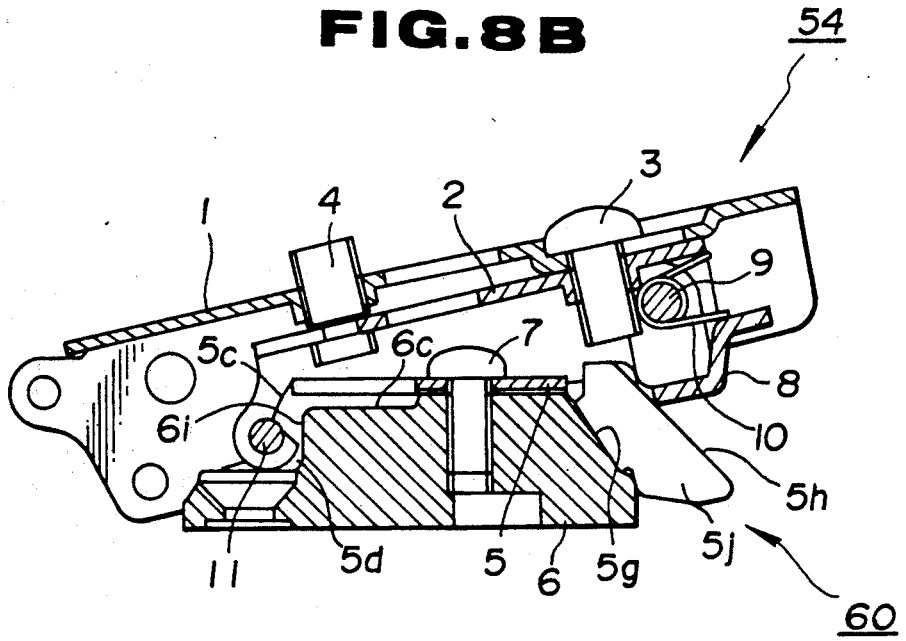

Then, as is seen from FIG. 8B, the first structure 54 is strongly pressed against the second structure 60. With this, the latch pin 11 is forced to slide on the sloped portions 5*c* and 5*c* and drop into the recessed portions 5*d* and 5*d* and as is seen from FIG. 8C, the latch member 8 (more specifically, the base part 8*d* of the latch member 8 (see FIG. 7)) is forced to slide on the sloped rear parts 5*h* and 5*h* against the biasing force of the coil spring 10. During the sliding movement of the latch member 8 on the sloped rear parts 5*h* and 5*h*, the first structure 54 is forced to pivot about the axis of the latch pin 11.

Figure 8C:
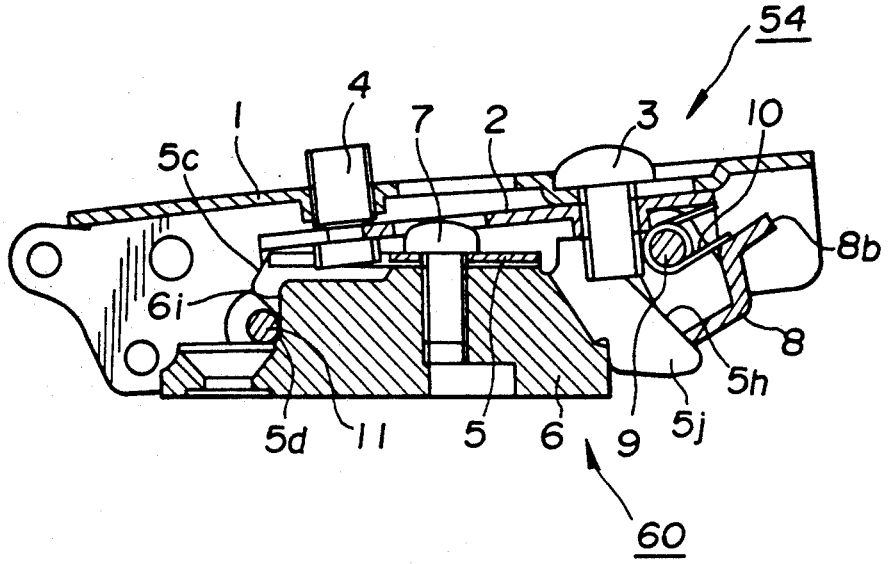
Figure 8D:
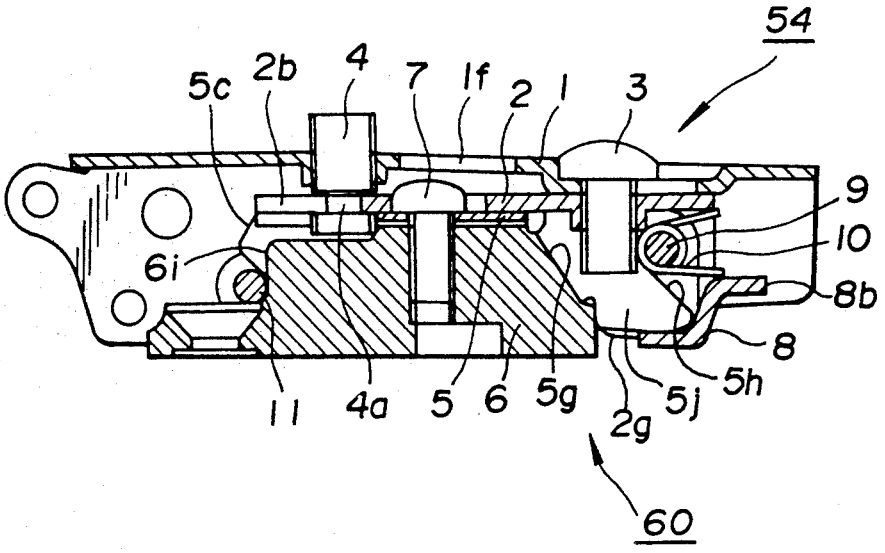

When the pressing of the first structure 54 against the second structure 60 is continued, the latch member 8 (more specifically, the base part 8*d* of the latch member 8) is finally dropped into lower recessed portions of the two pawl plates 5*j* and 5*j* with an aid of the biasing force of the coil spring 10, as is seen from FIG. 8D. With this, the first and second structures 54 and 60 are properly coupled, that is, these two structures 54 and 60 are latched to each other.

Figure 9:
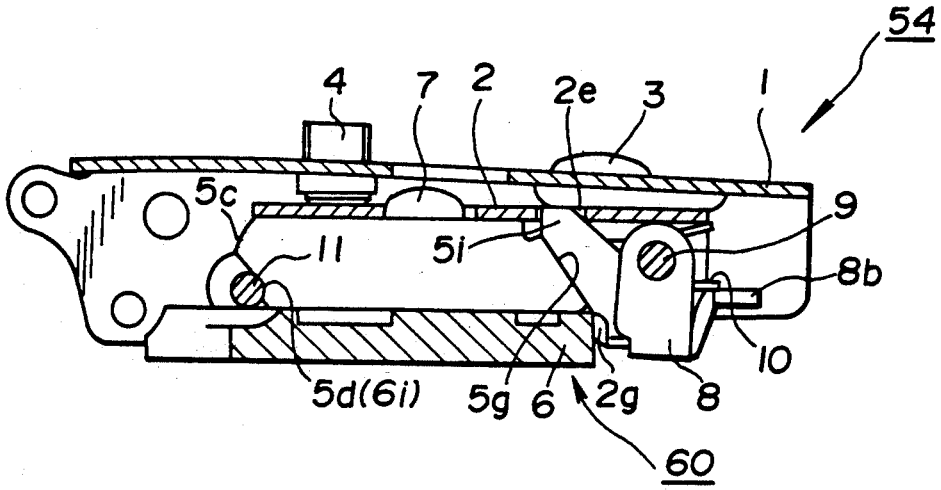
FIG. 9 is a sectional view of the first and second structures in a coupled condition.
Figure 10:
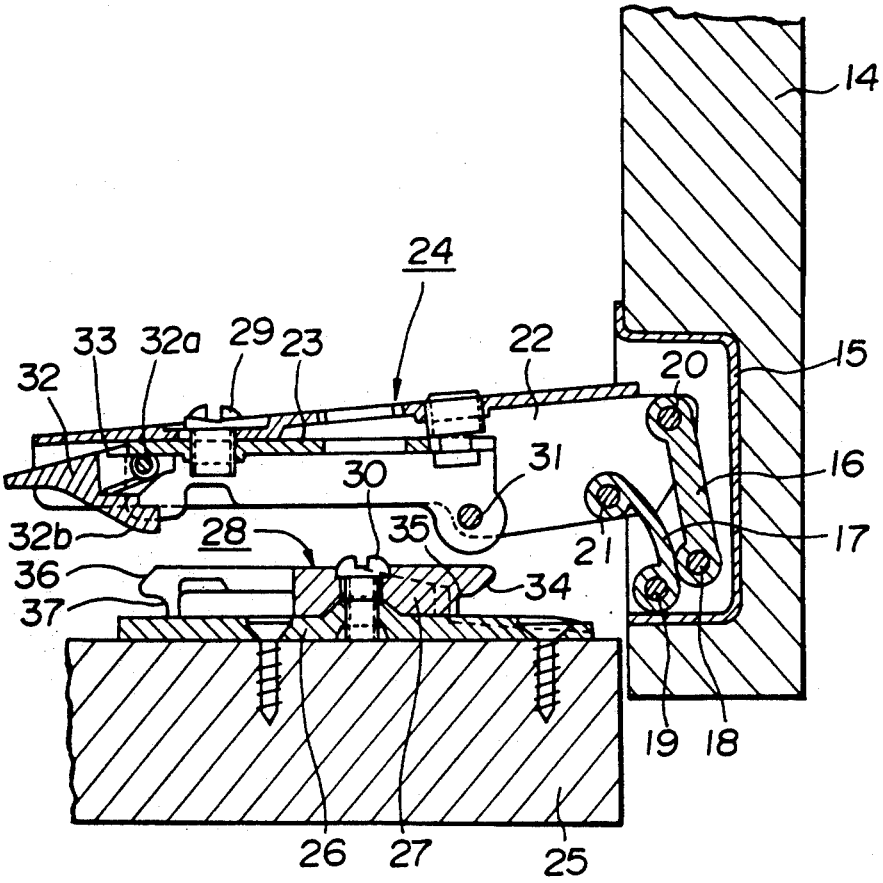
FIG. 10 (PRIOR ART)
FIG. 10 is a sectional view of a conventional adjustable hinge.

As will be understood from FIG. 9, when the the first and second structures 54 and 60 are properly coupled, projections (see FIG. 7) defined by the recessed portions 2*g* and 2*g* of the lever member 2 abut against a vertical edge of the base plate 6, the projected upper parts 5*i* and 5*i* of the pawl plates 5*j* and 5*j* are put in the slits 2*e* and 2*e* of the lever member 2, and the latch pin 11 of the lever member 2 abuts against both the vertical front wall 6*i* of the base plate 6 and the recessed portions 5*d* and 5*d* of the catch plate 5. Accordingly, under this condition, a longitudinal movement of the lever member 2 relative to the fixed catch plate 5 is suppressed. Furthermore, due to the latched engagement of the latch member 8 with the two pawl plates 5*j* and 5*j*, a pivotal movement of the lever member 2 about the latch pin 11 is suppressed. This means that the first structure 54 is tightly coupled with the second structure 60 without play.

As will be understood from FIGS. 1 and 6, even under this coupled condition of the first and second structures 54 and 60, the connecting bolt 7 for the catch plate 5 of the second structure 60 can be manipulated with a screw driver (not shown) through the mated openings 1*f* and 2*d* of the first structure 54.

When dismantling of the first structure 54 from the second structure 60 is needed, the T-shaped handle portion 8*b* of the latch member 8 is handled against the force of the coil spring 10. With this, the latched engagement of the latch member 8 with the two pawl plates 5*j* and 5*j* becomes cancelled and thus the first structure 54 assumes the position as shown in FIG. 8C. Thus, when the first structure 54 is pulled with a certain force, the same is easily dismantled from second structure 60.

In the following, the detail of the third structure 38 will be described with reference to FIGS. 1 to 4.

As is best seen from FIG. 2, the third structure 38 comprises a generally rectangular base member 40 which has two openings 43 and 43 through which screws 44 and 44 (see FIG. 1) are passed and screwed into a rigid portion of the door member 14 for securing the base member 40 to the door member 14. The base member 40 is integrally formed at its middle section with a recessed portion 39. The recess of the recessed portion 39 is sized and shaped to snugly receive therein the afore-mentioned cup member 15 of the first structure 24. The third structure 38 further comprises a movable rectangular stopper plate 41 which is movably attached to the base member 40. A bar spring 42 is connected to the base member 40 to bias the stopper plate 41 in a given lateral direction.

The base member 40 is formed at its middle part with a cut 46 which is merged with the interior of the recessed portion 39. In order to hold the bar spring 42, the base member 40 is formed at one lateral side thereof with two inclined slits 47 and 47 into which both ends of the bar spring 42 are received having a middle portion of the bar spring 42 arcuately protruded outward from the base member 40. As seen from FIG. 2, each slit 47 is formed with a stopper projection 48 against which the corresponding end of the bar spring 42 abuts.

The rectangular base member 40 is formed at lateral sides thereof with slide ridges 49 and 49 for the purpose which will become apparent from the following.

Figure 3:
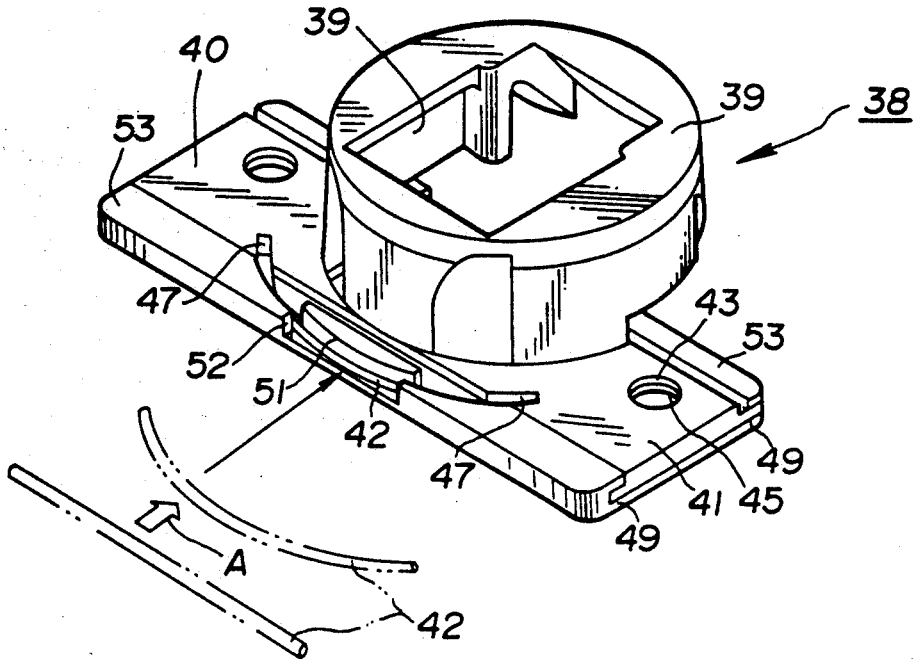
FIG. 3 is a back view of the third structure in assembled condition.
Figure 4:
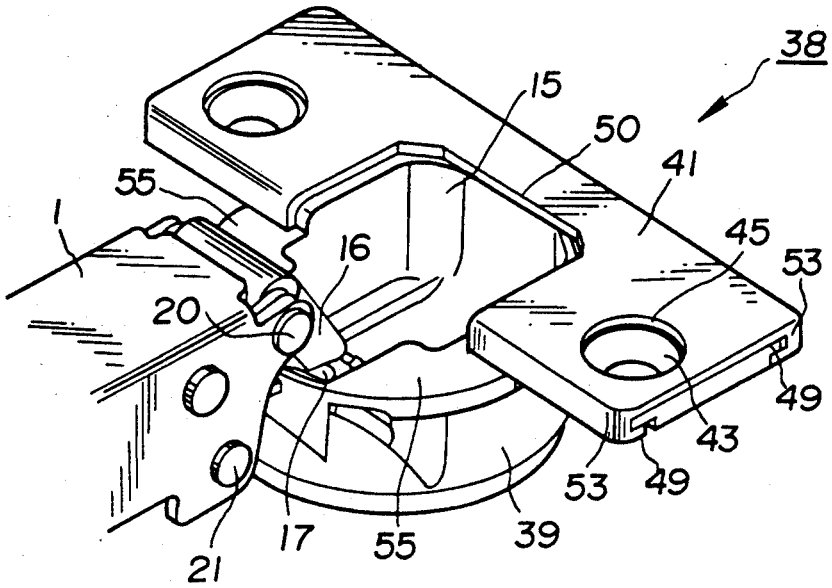
FIG. 4 is an enlarged but partial perspective view of the adjustable hinge of the invention, showing a condition in which the first and third structures are properly coupled.

As is seen from FIG. 3 which shows a back view of the base member 40 with the stopper plate 41 properly assembled therewith, the stopper plate 41 is formed at lateral thicker sides 53 and 53 thereof with guide grooves into which the slide ridges 49 and 49 of the base member 40 are axially and laterally movably received. For this axially and laterally movable receiving, the guide grooves of the stopper plate 41 are constructed somewhat larger than the slide ridges 49 and 49, as will be understood from FIG. 4.

As is seen from FIG. 3, the stopper plate 41 is formed at a middle part of one thicker lateral side 53 with an arcuate groove 51 into which the middle portion of the bar spring 42 is received. The thicker lateral side 53 has further a rectangular cut 52 which is merged with the arcuate groove 51 to expose the middle portion of the bar spring 42. It is thus to be noted that due to provision of the bar spring 42, the movable stopper plate 41 is biased in a direction opposite to the direction of the thicker arrow "A" relative to the base member 40 in FIG. 3. It is further to be noted that, as is understood from FIG. 3, the bar spring 42 is brought into the proper position while being flexed.

As is seen from FIG. 2, the movable stopper plate 41 is formed at its middle part with a cut 50 which has substantially the same shape as the cut 46 of the base member 40. The stopper plate 41 is formed with two openings 45 and 45 which are sized somewhat larger than the openings 43 and 43 of the base member 40.

For assembling the third structure 38, the movable stopper plate 41 is slid on the base member 40 from one axial end of the latter and stopped when the cut 50 of the stopper plate 41 coincides with the cut 46 of the base member 40 as is seen from FIG. 3. Then, the bar spring 42 is installed to the assembled unit of the base member 40 and the plate 41.

It is to be noted that the entire of the third structure 38 can be secured to the door member 14 without removing the movable stopper plate 41. This is because the openings 45 and 45 of the movable stopper plate 41 are sized larger than heads of the screws 44 (see FIG. 1).

In order to couple the first and third structures 54 and 38, the following coupling steps are carried out, which will be described with reference to FIGS. 1 and 5A to 5C.

First, as is seen from FIG. 1, the third structure 38 is placed near the first structure 54 facing the recessed portion 39 of the base member 40 toward the cup member 15 of the first structure 54.

Figure 5A:
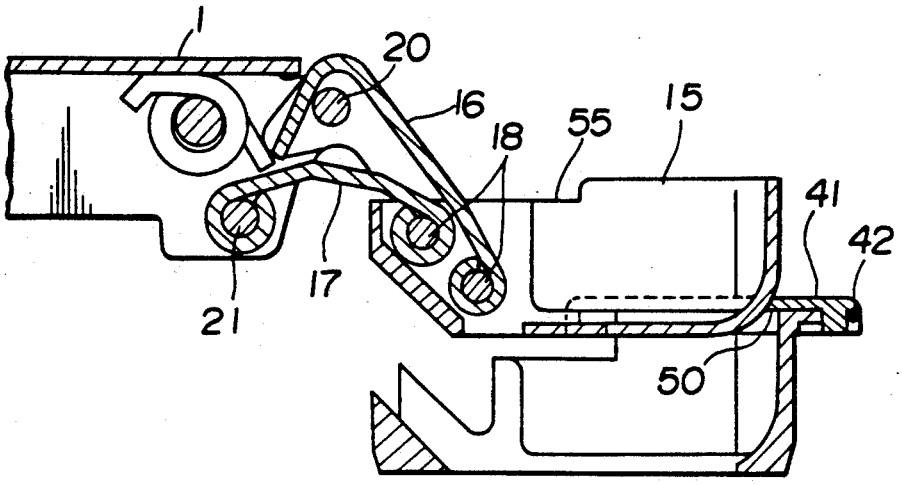
FIGS. 5A, 5B and 5C are sectional views of the adjustable hinge of the invention, showing the steps for coupling the first and third structures.
Figure 5B:
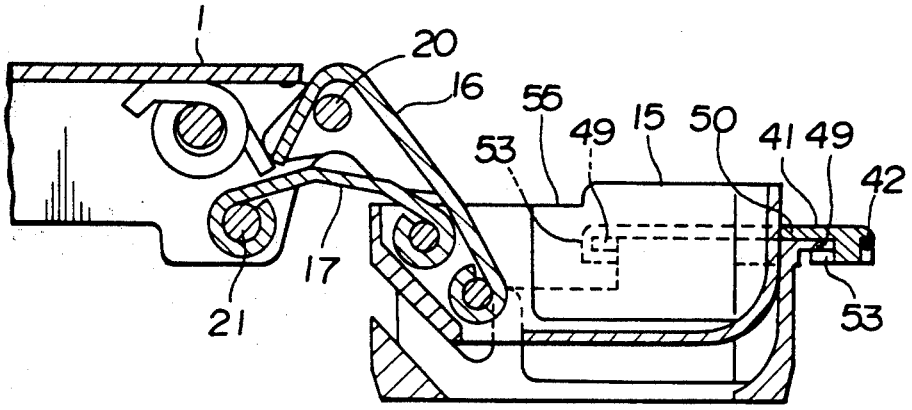

Then, the third structure 38 is brought to the first structure 54 causing a peripheral portion of the cut 50 of the movable stopper plate 41 to contact with the cup member 15, as is seen from FIG. 5A. Thus, the movable stopper plate 41 is moved laterally outwardly against the biasing force of the bar spring 42 permitting insertion of the cup member 15 into the recessed portion 39 of the base member 40, as is seen from FIG. 5B.

Figure 5C:
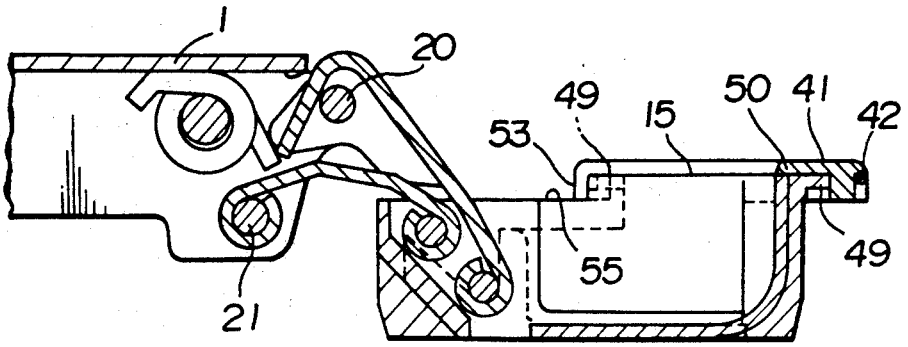

When, as is seen from FIG. 5C, the cup member 15 is fully received in the recessed portion 39, the movable stopper plate 41 is returned to the original position due to the biasing force of the bar spring 42. Under this condition, the peripheral portion of the cut 50 of the stopper plate 41 abuts against an upper edge of the cup member 15 and the forked outside portion of the stopper plate 41 abuts against the triangular small flanges 55 and 55 of the cup member 15. Thus, the cup member 15 of the first structure 54 is latched by the third structure 38, so that the door member 14 can pivotally move relative to the receptacle member 25 along a way determined by the two links 16 and 17.

In the following, advantages of the present invention over the conventional adjustable hinges will be described.

First, because the three major structures 54, 60 and 38 of the adjustable hinge of the invention have the above-mentioned constructions, the assembly of the hinge can be easily carried out without need for a skilled assembling technique. In fact, the coupling of the first structure 54 to the second structure 60 and that of the first structure 54 to the third structure 38 can be made with substantially one-touch handling. This induces quick and assured installation of the hinge to the door member and the receptacle member.

Second, because the relative positioning between the three structures 54, 60 and 38 can be adjusted by the three bolts 3, 4 and 7, the door member 14 can be exactly positioned with respect to the receptacle member 25.

Third, because of provision of the rectangular opening 1*f* of the arm member 1 and the oval opening 2*d* of the lever member 2, handling of the bolt 7 can be carried out from the outside of the hinge.

Fourth, because the hinge can be disassembled into three major structures 54, 60 and 38, the door member 14 and the receptacle member 25 can be easily conveyed. That is, such conveyance is carried out having the first structure 54 kept dismantled from the others.

What is claimed is:

1. An adjustable hinge comprising:

a first structure having a pivotal male member which is formed like a cup;

a second structure which is to be attached to a receptacle member and detachably connectable to said first structure;

a third structure which is to be secured to a door member and has a female member detachably engageable with said male member and having a cup-shaped recess which is sized and shaped to snugly receive therein the cup-shaped male member; and said third structure includes a latch means which latches the cup-shaped male member to said cup-shaped recess when the cup-shaped male member is fully received in said cup-shaped recess, wherein said latch means comprises a stopper plate moveable to a latching position wherein said cup-shaped male member in said cup-shaped recess is latched by said stopper plate;

guide means for permitting said stopper plate to move within a given area above said cup-shaped recess; and a bar spring for biasing said stopper plate toward said latching position.

2. An adjustable hinge as claimed in claim 1, in which said stopper plate is formed with a cut which is positioned above said cup-shaped recess, and in which when said stopper plate assumes said latching position, a peripheral edge of said cut abuts against an upper peripheral edge of said cup-shaped male member.

3. An adjustable hinge as claimed in claim 2, in which said cup-shaped male member is formed with two flanges against which forked portions of said stopper plate abut when said stopper plate assumes said latching position.

4. An adjustable hinge as claimed in claim 3, in which said flanges are located below the upper peripheral edge of said cup-shaped male member.

5. An adjustable hinge as claimed in claim 1, in which said guide means comprises:

a generally rectangular base member which has a cut merged with said cup-shaped recess, said base member being formed at lateral sides thereof with slide ridges; and guide grooves respectively formed at lateral sides of said stopper plate, said guide grooves receiving said slide ridges of the base member in a manner to permit a certain play of said stopper plate relative to said base member.

6. An adjustable hinge as claimed in claim 5, in which said base member is formed with two inclined slits into which both ends of said bar spring are received having a middle portion of the bar spring arcuately protruded outward from said base member, the outwardly protruded middle portion of said bar spring abutting against one side of said stopper plate thereby to bias said stopper plate toward said latching position.

7. An adjustable hinge comprising:

a first structure having a pivotal cup-shaped male member;

a second structure which is to be attached to a receptacle member and detachably connectable to said first structure;

said first structure comprising an arm member, two links through which said male member is pivotally connected to one end of said arm member, a lever member, connecting means for connecting said lever member to said arm member in such a manner that said lever member extends along the arm member, position changing means for permitting a position change of said lever member relative to said arm member, a part of coupling means by which said first and second structures are detachably coupled;

a third structure which is to be secured to a door member and has a female member detachably engageable with said male member;

said connecting means of said first structure comprising means defining a longitudinally extending opening formed in said arm member, a threaded opening formed in said lever member and a bolt which is adapted to be passed through said longitudinally extending opening and screwed into said threaded opening;

position changing means comprising means defining a threaded opening in said arm member;

means defining a longitudinally extending groove in said lever member; and a bolt having at its leading end portion an annular groove which has an eccentric bottom surface, said bolt being screwed into said threaded opening of said arm member having said annular groove slidably engaged with opposed edge portions of said longitudinally extending groove.

8. An adjustable hinge as claimed in claim 7, in which the part of said coupling means of said first structure comprises:

a pivotal latch member pivotally connected to one longitudinal end of said lever member, said latch member being engageable with a predetermined portion of said second structure to achieve a latched connection therebetween;

a spring for biasing said latch member in a direction to achieve said latched connection; and a latch pin held by the other longitudinal end of said lever member, said latch pin being engageable with another predetermined portion of said second structure to achieve a latched connection therebetween.

9. An adjustable hinge as claimed in claim 8, in which said pivotal latch member is integrally formed with a generally T-shaped handle portion which extends outward from said latch member.

10. An adjustable hinge as claimed in claim 9, in which said second structure comprises:

a base plate to be secured to said receptacle member;

a catch plate;

connecting means for detachably connecting said catch plate to said base plate; and another part of said coupling means by which said first and second structures are detachably coupled.

11. An adjustable hinge as claimed in claim 10, in which said another part of said coupling means comprises:

two identical pawl plates secured to a longitudinal rear end of said lever member, to which said pivotal latch member is latchedly engageable, each pawl plate including a sloped rear part and a projected upper part; and means defining at front end of said lever member two recessed portions with which said latch pin is latchedly engageable.

12. An adjustable hinge as claimed in claim 11, in which said connecting means comprises:

means defining a laterally extending slot in said catch plate;

means defining a threaded opening in said base plate; and a bolt passed through said slot and screwed into said threaded opening to secure said catch plate to said base plate.

13. An adjustable hinge as claimed in claim 12, in which said catch plate is formed with two pairs of lateral flanges which are seated on flat bottom surfaces of recesses formed in said base plate.

14. An adjustable hinge as claimed in claim 9, in which said catch plate has a channel structure and is mounted on an elongate raised portion formed on said base plate.

15. An adjustable hinge as claimed in claim 11, in which the projected upper parts of said two identical pawl plates are snugly received in respective recesses formed in said lever member of said first structure when said first and second structures are properly coupled.

16. An adjustable hinge as claimed in claim 12, in which said arm member and said lever member of said first structure are formed with mated openings through which said bolt of said second structure is viewed from outside when said first and second structures are properly coupled.

* * * * *